US009496657B1

(12) United States Patent
Chang et al.

(10) Patent No.: US 9,496,657 B1
(45) Date of Patent: Nov. 15, 2016

(54) ELECTRICAL CONNECTOR STRUCTURE

(71) Applicant: SPEED TECH CORP., Taoyuan (TW)

(72) Inventors: Hao-Che Chang, Taoyuan (TW); Chih-Cheng Chen, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 15/132,261

(22) Filed: Apr. 19, 2016

(30) Foreign Application Priority Data

Aug. 17, 2015 (TW) ..... 104213229 U

(51) Int. Cl.
*H01R 13/6597* (2011.01)
*H01R 13/6471* (2011.01)
*H01R 24/76* (2011.01)

(52) U.S. Cl.
CPC ..... *H01R 13/6597* (2013.01); *H01R 13/6471* (2013.01); *H01R 24/76* (2013.01)

(58) Field of Classification Search
CPC ..... H01R 13/6597; H01R 13/6471
See application file for complete search history.

(56) References Cited

U.S. PATENT DOCUMENTS 3,587,029 A * 6/1971 Knowles ..... H01R 13/6471 439/108
8,808,029 B2 * 8/2014 Castillo ..... H01R 13/6585 439/607.05
8,944,849 B1 * 2/2015 Yang ..... H01R 13/6588 439/607.07
9,385,482 B2 * 7/2016 Li ..... H01R 13/6585
2002/0061669 A1 * 5/2002 Yu ..... H01R 13/65802 439/95
2012/0184145 A1 * 7/2012 Zeng ..... H01R 13/6585 439/626
2013/0288513 A1 * 10/2013 Masubuchi ..... H01R 12/775 439/386
2014/0364006 A1 * 12/2014 Lo ..... H01R 13/6461 439/607.01
2016/0028190 A1 * 1/2016 Chen ..... H01R 13/6581 439/607.01

FOREIGN PATENT DOCUMENTS

TW M299955 U 10/2006

* cited by examiner

*Primary Examiner* — James Harvey
(74) *Attorney, Agent, or Firm* — CKC & Partners Co., Ltd.

(57) ABSTRACT

An electrical connector structure includes an insulating body, ground terminals, and a grounding piece. The insulating body has a divider block. The ground terminals are fixed on the insulating body and arranged in two opposite sides of the divider block. Each ground terminal has a docking portion, a main portion, and a tail portion. The main portions are fixed on the insulating body. The docking portions and the tail portions extend from two sides of the insulation body. The grounding piece is fixed on the divider block. The grounding piece has a first mounting plane and a second mounting plane corresponding to the first mounting plane. The first mounting plane and the second mounting plane are located at two opposite surfaces of the divider block, and have contact portions protruding therefrom. The contact portions electrically contact the ground terminals respectively.

12 Claims, 13 Drawing Sheets

ELECTRICAL CONNECTOR STRUCTURE

RELATED APPLICATIONS

This application claims priority to Taiwan Application Serial Number 104213229, filed Aug. 17, 2015, which is herein incorporated by reference.

BACKGROUND

Field of Invention

The present invention relates to an electrical connector structure. More particularly, the present invention relates to an electrical connector structure which is capable of reducing high frequency electromagnetic noises.

Description of Related Art

Due to the amount of data transmitted between electrical devices continues to increase, the signal transmitting speeds between the electrical devices also increase accordingly, thereby providing users with more user friendly experience. In order to allow the users to transmit a large amount of electrical data within a shorter period of time, apart from increasing the gateways of transmitting electrical signals between the electrical devices, a conventional countermeasure is to increase an electrical signal transmitting frequency between the electrical devices. However, with the trend of miniaturization of the electronic devices, the electrical signals are likely to cause crosstalk, thus causing the electrical signals originally transmitted to generate noises. Therefore, in the situation of continuously increasing the electrical signal transmitting frequency between different electrical devices, a connector has to consider the adverse effect on the electrical signals passing through the connector, and control the factors resulting in the adverse effect on the transmission of the electrical signals or take a proper countermeasure to lower its substantial influence. In a conventional electrical connector, a metal shell is generally used to block cross influence of electromagnetic waves between inside and outside of the electrical connector, and then conductive terminals are used to transmit noises in the electrical connector to a ground circuit, thereby reducing the adverse effect on the electrical signals transmission caused by noises, thus enabling the electrical signals to be transmitted between the electrical devices completely.

Referring to U.S. Pat. No. 8,808,029 as shown in FIG. 1 and FIG. 2, a high density connector structure for transmitting high frequency signals is disclosed, in which an shielding board A includes resilient arms B arranged at intervals. In such disclosure, the high density connector structure for transmitting high frequency signals has terminals arranged in upper and lower columns, in which the terminals in the upper and lower columns all include signal terminals and ground terminals. Each of the signal terminals is arranged between the ground terminals, and the resilient arms B of the shielding board A are disposed towards and electrically contact the ground terminals in the upper column respectively. If the resilient arms B of the shielding board A desire to be disposed towards and electrically contact the ground terminals in the upper and lower columns, since the shielding board A is a metal thin plate, the resilient arms B have be formed alternately upwards and downwards on the metal thin plate, so as to electrically contact the ground terminals in the upper and lower columns. Consequently, the shielding board A also indirectly restricts the ground terminals in the upper and lower columns to be located at the different positions. When the ground terminals in the upper and lower columns are located corresponding to the same position, the shielding board A has to be divided into two parts, thereby allowing the resilient arms B to electrically contact the ground terminal in the upper column.

Referring to Taiwan Utility Model Patent Number M299955 as shown in FIG. 3 and FIG. 4, a connector having a structure for reducing electromagnetic interference is disclosed, in which a ground plate C includes ground tabs D1 and shielding plates D2. In such disclosure, the shielding plates D2 and the ground tabs D1 are designed as protrusive tabs, and the shielding plates D2 shield the noises generated when signals are transmitted between neighboring signal terminals. The ground tabs D1 are arranged in alternate up and down manner and contact ground terminals respectively. In the disclosure of the aforementioned conventional skill, the connector having a structure for reducing electromagnetic interference has plural terminals arranged in upper and lower columns, in which the terminals in the upper and lower columns all include plural signal terminals and plural ground terminals, and the signal terminals are arranged between the ground terminals.

In the aforementioned conventional skill, since the ground terminals arranged in the upper and lower columns are alternately disposed on a specific projection plane, plural ground tabs D1 can be made on one single metal shielding plate, thereby allowing a portion of the ground tabs D1 to contact the ground terminals arranged in the upper column, and the other portion of the ground tabs D1 to contact the ground terminals arranged in the lower column.

However, in the above disclosures of US Patent Number U.S. Pat. No. 8,808,029 and Taiwan Utility Model Patent Number M299955, when the ground terminals in the upper and lower columns on the projection plane are located at similar or the same positions, due to the surface limitation of the insulator material, plural resilient arms B cannot extend from at the same position of the insulator A, or the ground tabs D1 with opposite directions cannot be disposed on the insulator A, and thus there is a need to improve such disadvantages.

SUMMARY

A primary object of the present invention is to provide an electrical connector structure, and more particularly, to provide an electrical connector structure designed by using an insulating body, plural ground terminals, and a grounding piece, thereby having a function of reducing high frequency electromagnetic noises.

A secondary object of the present invention is to provide an electrical connector structure, and more particularly, to provide an electrical connector structure is designed by using an insulating body, plural ground terminals, and a grounding piece, thereby having a brief structure, thus promoting assembling efficiency.

To achieve the above objects, the present invention provides an electrical connector structure including an insulating body, plural ground terminals, plural signal terminals, and a grounding piece, in which the insulating body has a divider block. The ground terminals and the signal terminals are fixed on the insulating body and arranged on two opposite sides of the divider block. Each of the ground terminals and the signal terminals has a docking portion, a main portion, and a tail portion. The docking portions electrically contact a docking connector. The main portions are connected to the docking portions and the tail portions. Each of the main portions is fixed on the insulating body. Each of the tail portions extends from the insulating body. The grounding piece is formed from a metal thin plate The grounding piece has a first mounting plane and a second mounting plane corresponding to the first mounting plane, in which the first mounting plane and the second mounting plane are positioned at the divider block. The first mounting plane and the second mounting plane have plural contact portions protruding from the first mounting plane and the second mounting plane. The contact portions electrically contact the ground terminals respectively.

In order to further understand the characteristics, features, and art of present invention, please refer to the following detailed description and accompanying drawings. However, the accompanying drawings are merely provided for reference and explanation, and do not intend to limit the present invention.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
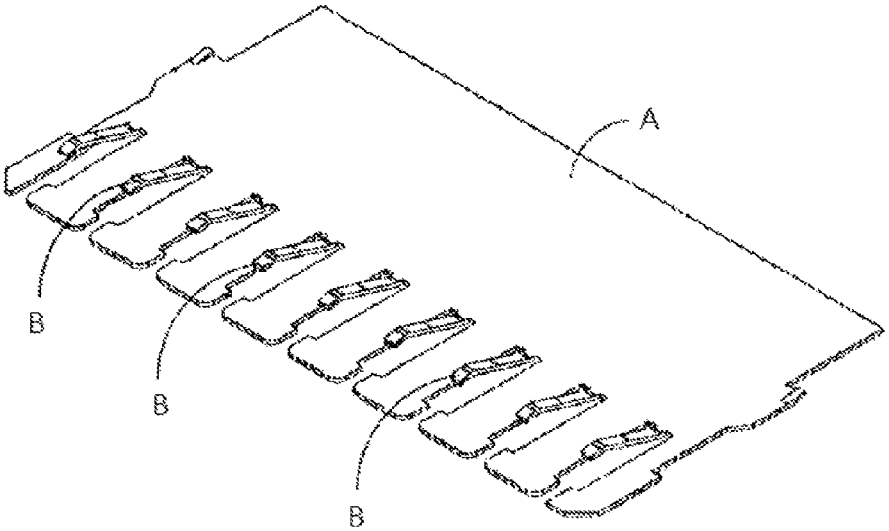
FIG. 1 (Prior Art)
FIG. 1 is a schematic diagram showing a partial structure according to the prior art of US Patent Number U.S. Pat. No. 8,808,029.
Figure 2:
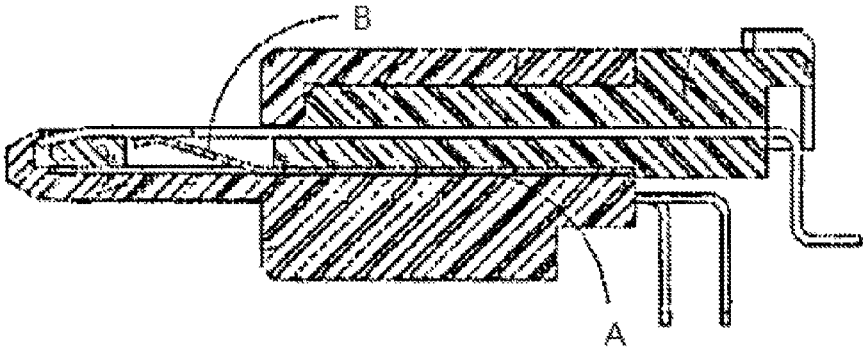
FIG. 2 (Prior Art)
FIG. 2 is a schematic side view of the partial structure according to the prior art of US Patent Number U.S. Pat. No. 8,808,029.
Figure 3:
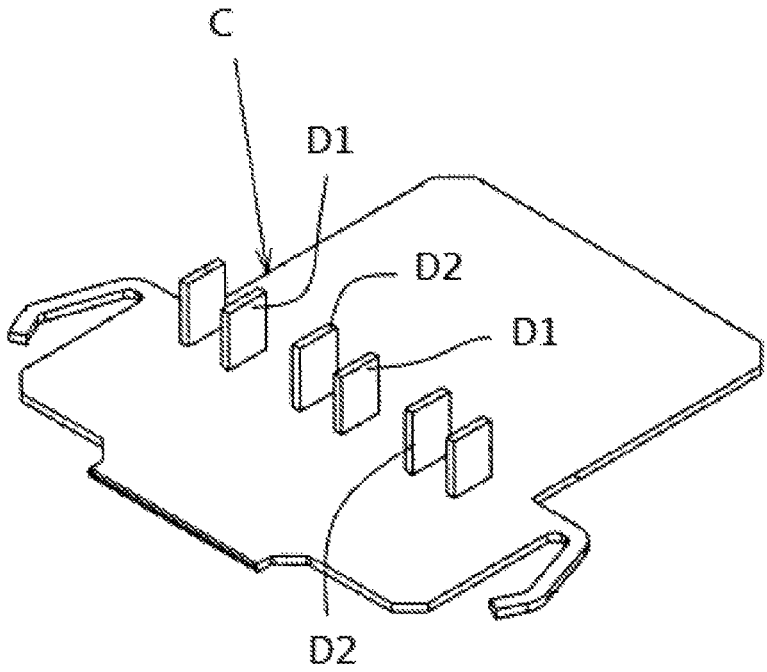
FIG. 3 (Prior Art)
FIG. 3 is a schematic diagram showing a partial structure according to the prior art of Taiwan Utility Model Patent Number M299955.
Figure 4:
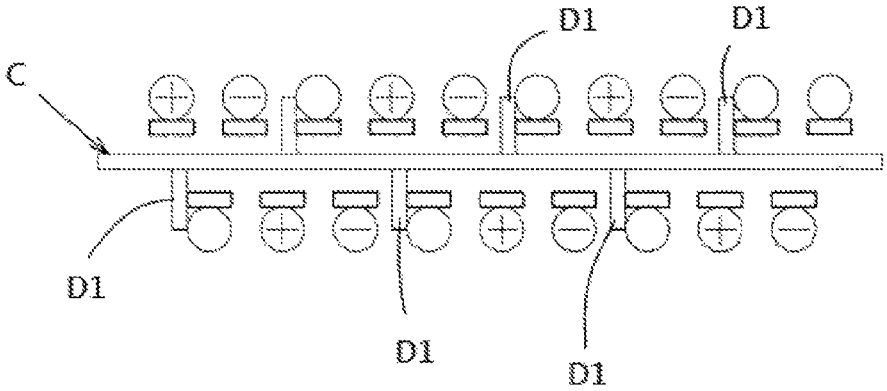
FIG. 4 (Prior Art)
FIG. 4 is a schematic view showing relationships of ground terminals according to the prior art of Taiwan Utility Model Patent Number M299955.

Referring to FIGS. 5-10, an electrical connector structure 1 of a first embodiment of the present invention is shown. The electrical connector structure 1 includes an insulating body 10, ground terminals 11, signal terminals 12, and a grounding piece 13. The insulating body 10 is formed from a first insulator 101, a second insulator 102, and a divider block 103. In the first embodiment of the present invention, the insulating body 10 is formed from three pieces of insulating material including the first insulator 101, the second insulator 102, and the divider block 103. However, in an actual operation, the insulating body 10 may be formed from only two pieces of insulating material, or may be monolithically formed from one single piece of insulating material.

The signal terminals 12 of the present invention are plural pairs of differential signal terminals, which are used to transmit high frequency electrical signals in a differential mode. Each of the signal terminals 12 is arranged between the ground terminals 11, and the ground terminals 11 may electrically contact a docking connector (not shown) or a grounding circuit to form a grounding path, so as to reduce a noise interference generated when the signal terminals 12 transmit signals. In the first embodiment of the present invention, the ground terminals 11 and the signal terminals 12 are fixed on the insulating body 10 and arranged on two opposite sides of the divider block 103. Each of the signal terminals 12 and the ground terminals 11 has a docking portion 110 and 120, a main portion 111 and 121, and a tail portion 112 and 122. The main portions 111 and 121 are respectively connected to the docking portions 110 and 120 and the tail portions 112 and 122. Each of the main portions 111 and 121 is fixed on the insulating body 10. Each of the docking portions 110 and 120 and each of the tail portions 112 and 122 extend from two sides of the insulating body 10.

In the first embodiment of the present invention, the divider block 103 is located between the first insulator 101 and the second insulator 102, and each of the main portions 111 of the ground terminals 11 and each of the main portions 121 of the signal terminals 12 are fixed on the first insulator 101 and the second insulator 102 respectively, such that each of the docking portions 110 and 120 of the ground terminals 11 and the signal terminals 12 extends from the first insulator 101 and the second insulator 102 arranged in two opposite rows. Meanwhile, each of the ground terminals 11 fixed on the first insulator 101 and each of the ground terminals 11 fixed on the second insulator 102 may be projected on a virtual plane on the divider block 103 respectively, and each of the ground terminals 11 fixed on the first insulator 101 and each of the ground terminals 11 fixed on the second insulator 102 coincide or nearly coincide on the virtual projection plane.

In the first embodiment of the present invention, each of the docking portions 110 and 120 of the ground terminals 11 and the signal terminals 12 is an elastomer which is elastically deformable. The end of each of the docking portions 110 and 120 is a free end which is elastically deformable. To those skilled in the art, it is not uncommon that the end of each of the docking portions 110 and 120 of the ground terminals 11 and the signal terminals 12 located away from the main portions 111 and 121 is a free end which is elastically deformable. Similarly, the end of each of the docking portions 110 and 120 of the ground terminals 11 and the signal terminals 12 may receive a pre-loaded application from the first insulator 101 and the second insulator 102, which can be easily known from the disclosure of the present invention by those skilled in the art.

Figure 7:
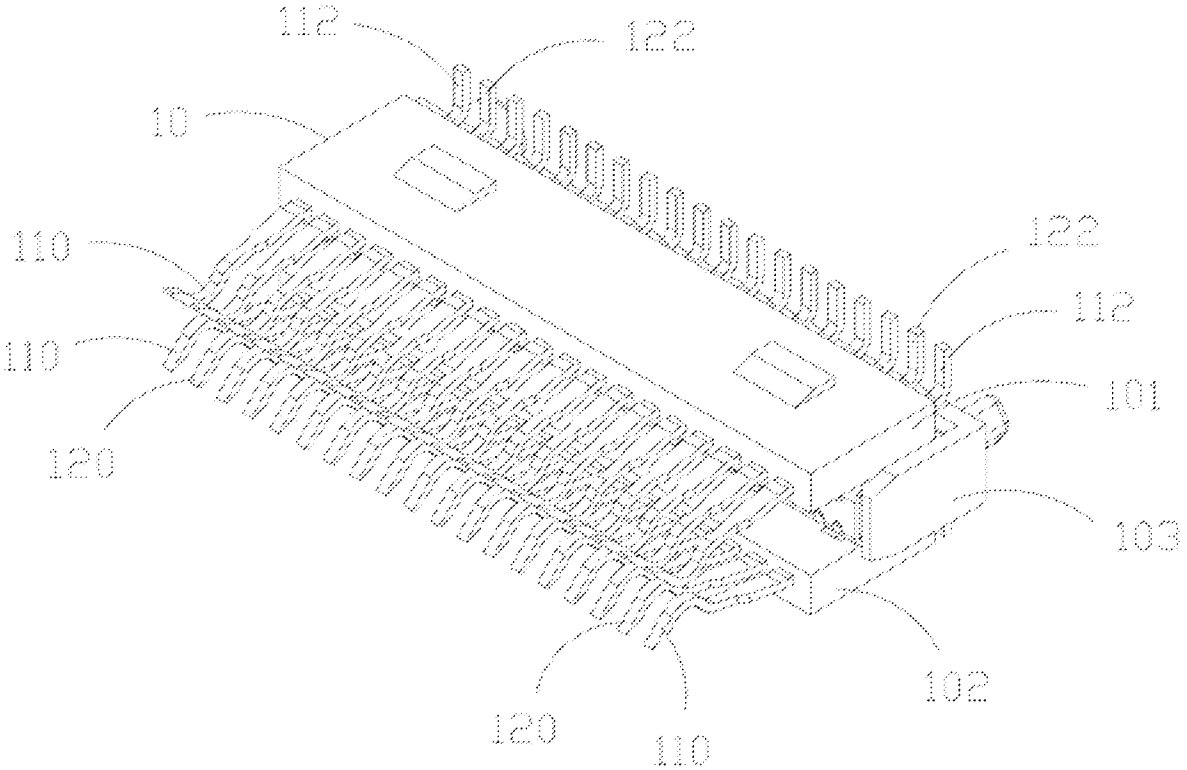
FIG. 7 is a schematic diagram showing a partial structure of the electrical connector structure according to the first embodiment of the present invention.

As shown in FIG. 7, the tail portions 112 and 122 of the ground terminals 11 and the signal terminals 12 extend from the first insulator 101 and the second insulator 102. The tail portions 112 and 122 of the ground terminals 11 and the signal terminals 12 may be electrically connected to a proper circuit on a circuit board. In the first embodiment of the present invention, the first insulator 101 has first openings 104. The second insulator 102 has second openings 105. The first openings 104 and the second openings 105 are corresponding to the main portions 111 and 121 of the ground terminals 11 and the signal terminals 12 respectively, such that the main portions 111 and 121 of the ground terminals 11 and the signal terminals 12 are partially exposed from the insulators 101 and 102 through the openings 104 and 105.

Figure 8:
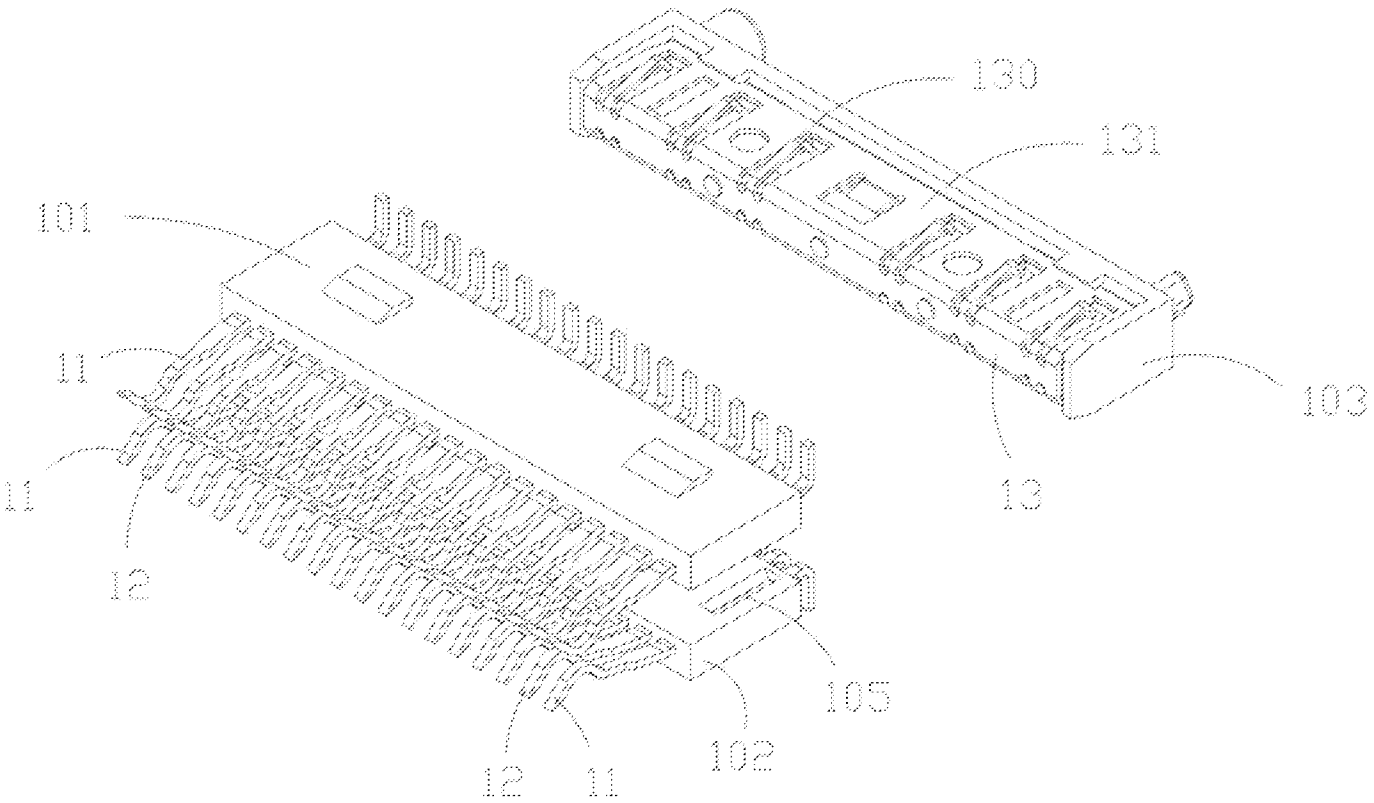
FIG. 8 is a schematic diagram showing a partial structure of the electrical connector structure according to the first embodiment of the present invention.
Figure 9:
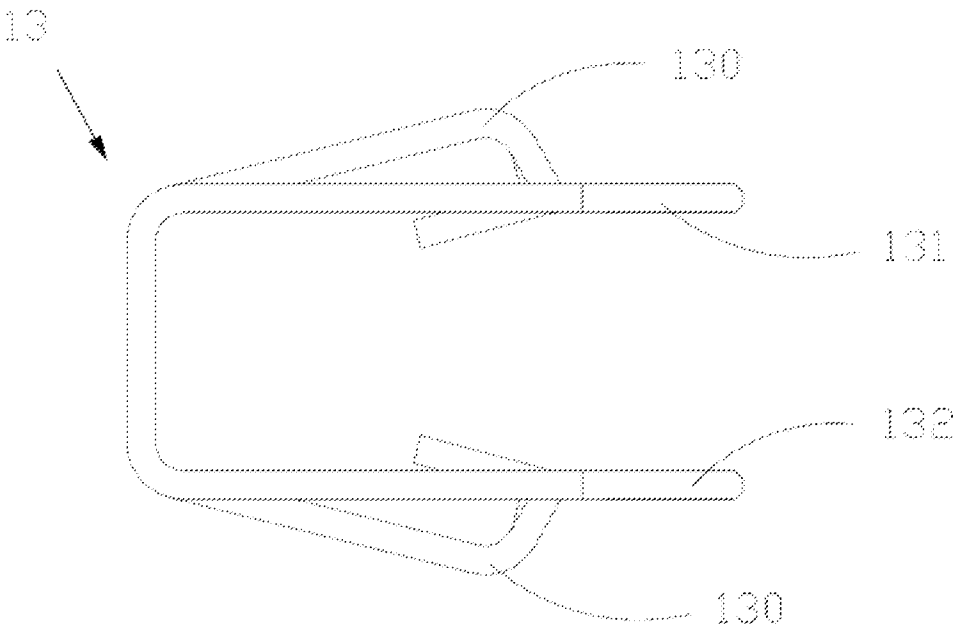
FIG. 9 is a schematic diagram showing a partial structure of the electrical connector structure according to the first embodiment of the present invention.
Figure 10:
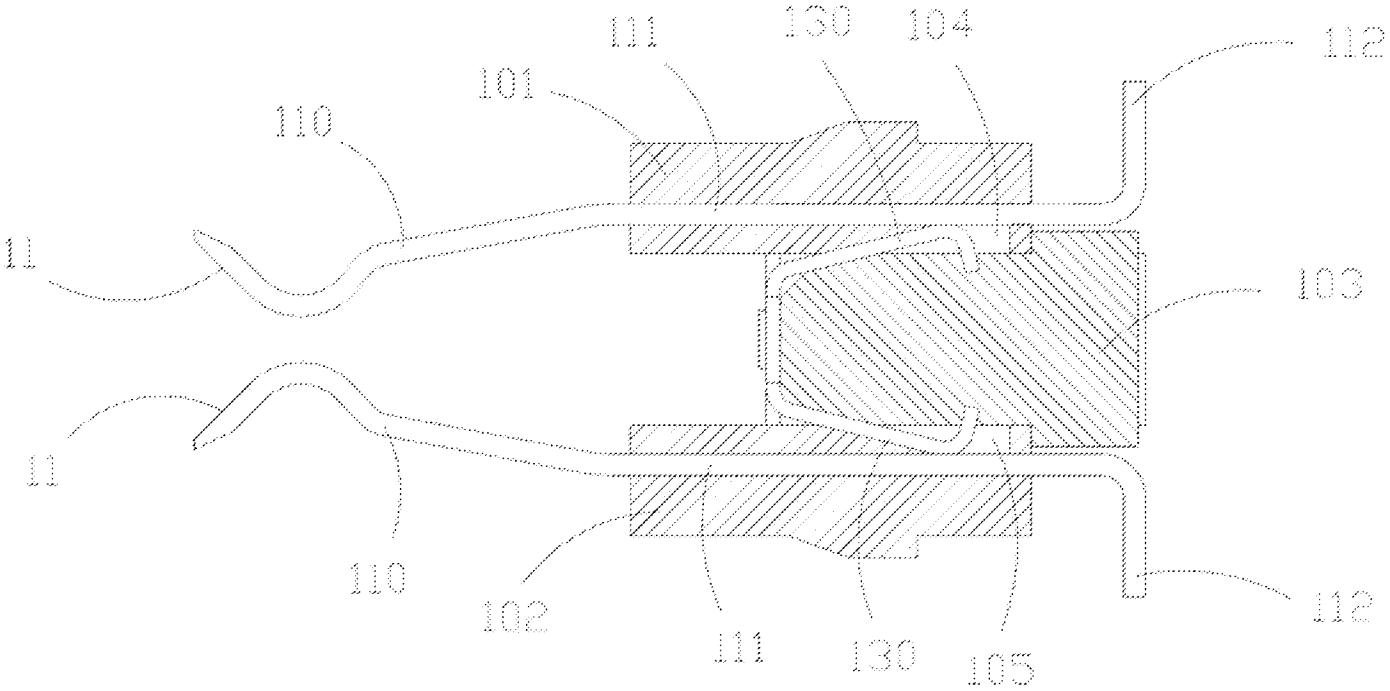
FIG. 10 is a schematic cross-sectional view of the electrical connector structure according to the first embodiment of the present invention.
Figure 11:
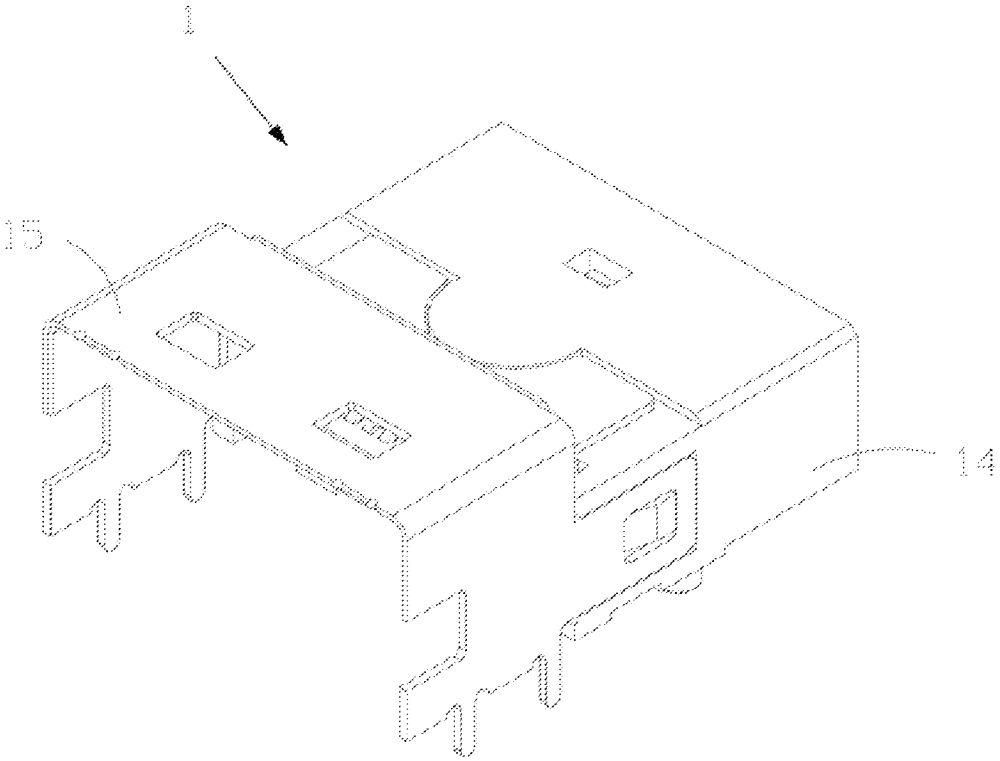
FIG. 11 is a schematic view showing an appearance of an electrical connector structure according to a second embodiment of the present invention.
Figure 12:
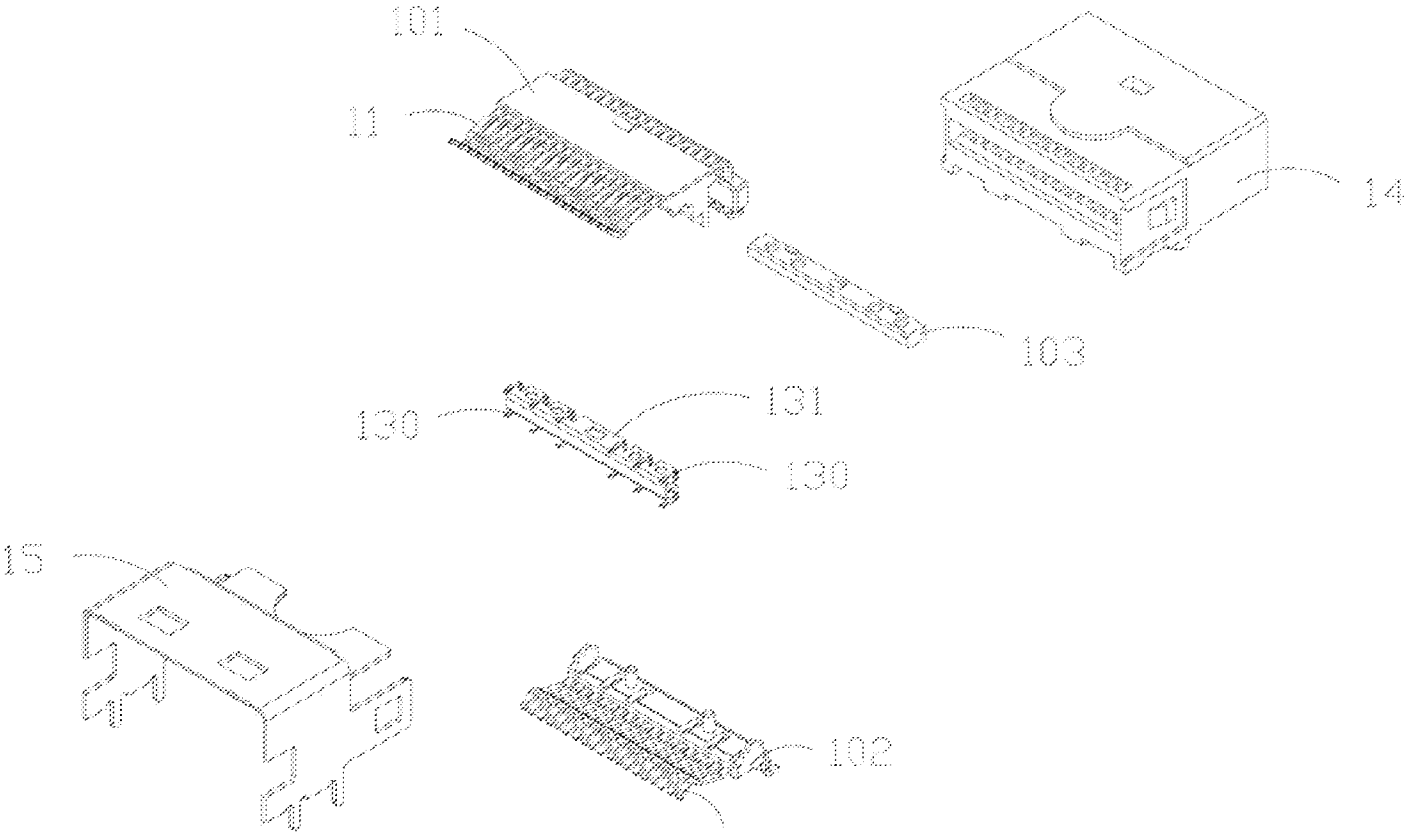
FIG. 12 is an exploded view of the electrical connector structure according to the second embodiment of the present invention.

In the first embodiment of the present invention, the grounding piece 13 is formed from a metal thin plate, and is folded to have a first mounting plane 131 and a second mounting plane 132 corresponding to each other, such that the grounding piece 13 has a substantially U-shaped cross-section. The grounding piece 13 is fixed on the divider block 103. Therefore, the first mounting plane 131 and the second mounting plane 132 are located on two opposite surfaces of the divider block 103. As shown in FIG. 8, the grounding piece 13 has contact portions 130 installed on the first mounting plane 131 and the second mounting plane 132. As shown in FIG. 9 and FIG. 10, the contact portions 130 electrically contact the main portions 111 of the ground terminals 11 through the first openings 104 and the second openings 105.

In the aforementioned electrical connector structure, the grounding piece 13 is fixed on an exterior surface of the divider block 103, and the contact portions 130 of the grounding piece 13 are installed on the first mounting plane 131 and the second mounting plane 132, and the contact portions 130 of the first mounting plane 131 are corresponding to the contact portions 130 of the second mounting plane 132. Each of the contact portions 130 is an elastomer which is elastically deformed when force is exerted thereon. As shown in FIG. 9 and FIG. 10, the contact portions 130 of the first mounting plane 131 electrically contact the main portions 111 of the ground terminals 11, and the contact portions 130 of the second mounting plane 132 electrically contact the main portions 111 of the ground terminals 11, such that the ground terminals 11 can be electrically conducted to each other at the same time through the grounding piece 13, thereby increasing the surface area of each of the ground terminals 11 and providing an additional grounding path of each of the ground terminals 11.

In the first embodiment of the present invention, the grounding piece 13 is U-shaped, and is formed by folding a metal thin plate. However, in an actual operation, the grounding piece 13 may also be formed by folding another type of conductive thin plate, in which the conductive thin plate may be formed from a non-metal material which undergoes a surface treatment, a chemical deposition process, or an electroplating process to become conductive. The contact portions 130 of the grounding piece 13 are installed on two opposite side arms of the U-shaped grounding piece 13. In the present embodiment, the side arms are used as the first mounting plane 131 and the second mounting plane 132.

Figure 5:
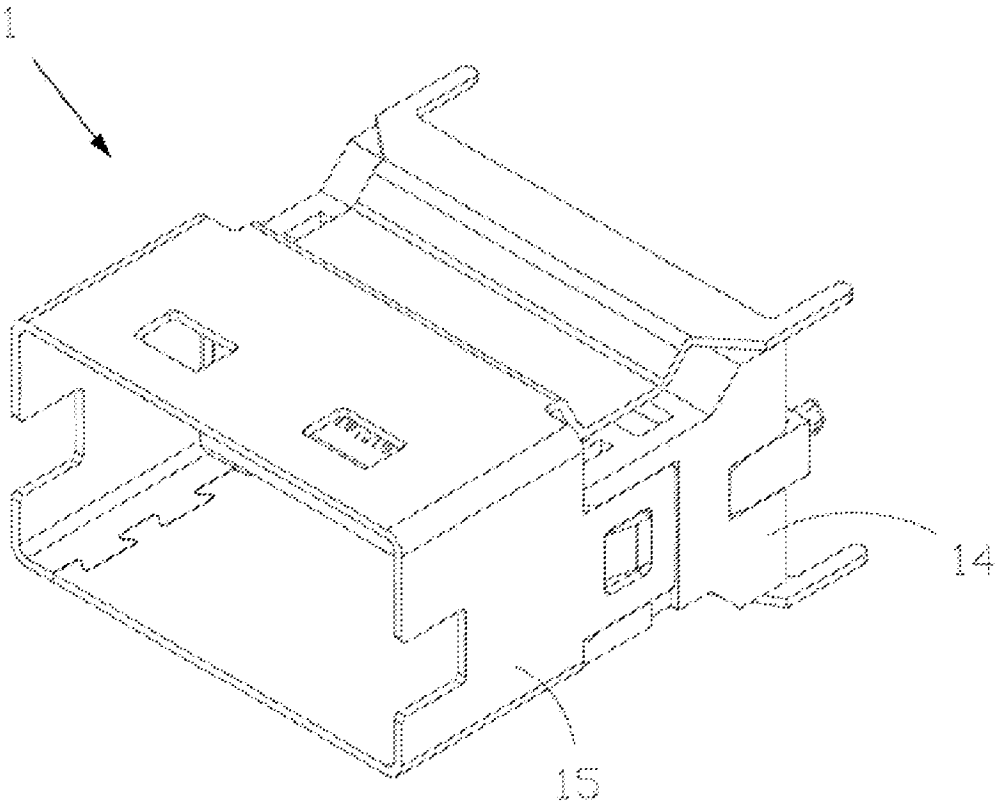
FIG. 5 is a schematic view showing an appearance of an electrical connector structure according to a first embodiment of the present invention.
Figure 6:
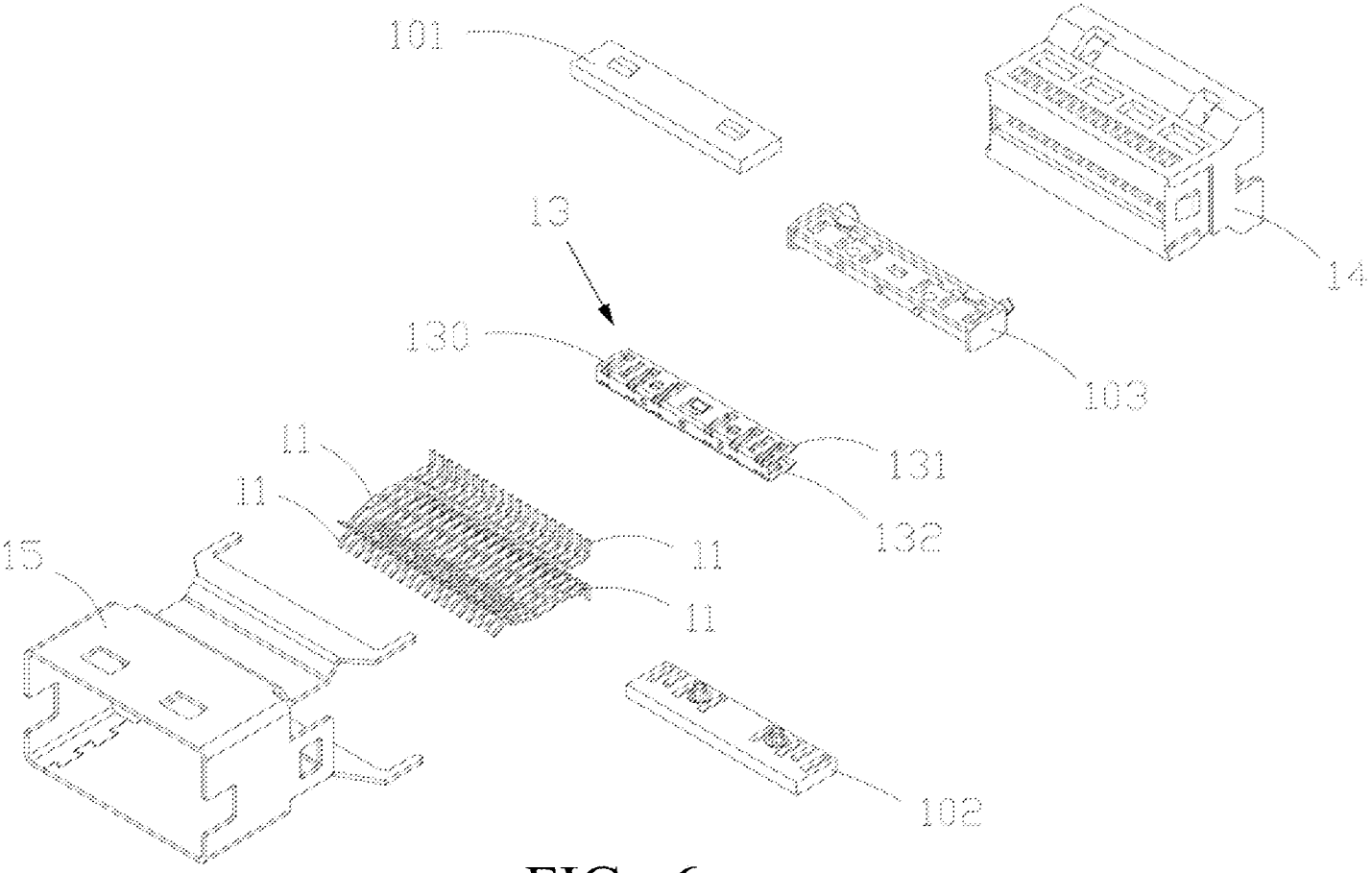
FIG. 6 is an exploded view of the electrical connector structure according to the first embodiment of the present invention.

When the first embodiment of the present invention is in an actual operation, the grounding piece 13 is first formed by stamping and folding a metal thin plate, and is installed on the divider block 103. In the first embodiment of the present disclosure, the grounding piece 13 is formed by stamping and folding one single metal thin plate. However, in actual use, the grounding piece 13 may be also formed from plural metal thin plates. Thereafter, each of the main portions 121 of the signal terminals 12 and each of the main portions 111 of the ground terminals 11 are insert molded in the first insulator 101 and the second insulator 102 respectively. Then, the first insulator 101 and the second insulator 102 are installed on two opposite sides of the divider block 103. Meanwhile, the contact portions 130 of the first mounting plane 131 located on the grounding piece 13 electrically contact the respective main portions 111 of the ground terminals 11 through the first openings 104 of the first insulator 101. The contact portions 130 of the second mounting plane 132 located on the grounding piece 13 electrically contact the respective main portions 111 of the ground terminals 11 through the second openings 105 of the second insulator 102. Thereafter, as shown in FIG. 5 and FIG. 6, an insulating frame 14 is installed outside the insulating body 10, and a metal shell 15 is also installed outside the insulating frame 14.

In the first embodiment of the present invention, each of the contact portions 130 of the grounding piece 13 is an elastomer with elastic recovery capability. However, in actual use, each of the contact portions 130 may also be a protrusion with no elastic recovery capability, or a similar material structure with mechanical rigidity, in which the mechanical rigidity is used to force each of the ground terminals 11 to be contacted.

Because the metal shell 15 is installed outside the insulating frame 14, when the electrical connector structure is docked with the docking connector (not shown), the metal shell 15 can be used to isolate the inner and outer electromagnetic interference. The insulating frame 14 also can be used to restrict the relative positions of the three insulating material pieces 101,102 and 103 in the present embodiment. The metal shell 15 also can be used to guide the electrical connector structure to match the docking connector. Grounding the electromagnetic wave is an effective strategy to suppress electromagnetic noises. Therefore, the grounding piece 13 is installed on the divider block 103, and the contact portions 130 are made to electrically contact the ground terminals 11 respectively, such that the ground terminals 11 are electrically connected to each other through the grounding piece 13, thereby achieving the functions of increasing the surface area of each of the ground terminals 11 and increasing the grounding path of each of the ground terminals 11, thus enabling the electrical connector structure to have the function of suppressing high frequency electromagnetic noises when high frequency signals are transmitted.

For convenience of explanation, in an electrical connector structure as shown in FIGS. 11-15, the structures the same as those of the first embodiment shown in FIGS. 5-10 are represented by the same reference numbers, and are not described again.

As shown in FIGS. 11-15, an electrical connector structure 1 of the second embodiment of the present invention is provided, and includes an insulating body 10, ground terminals 11, signal terminals 12, and a grounding piece 13. The insulating body 10 is formed from a first insulator 101, a second insulator 102, and a divider block 103. The ground terminals 11 and the signal terminals 12 are fixed on the insulating body 10 and arranged on two opposite sides of the divider block 103. Each of the signal terminals 12 and the ground terminals 11 has a docking portion 110 and 120, a main portion 111 and 121, and a tail portion 112 and 122. The main portions 111 and 121 are respectively connected to the docking portions 110 and 120 and the tail portions 112 and 122. Each of the main portions 111 and 121 is fixed on the insulating body 10. Each of the docking portions 110 and 120 and each of the tail portions 112 and 122 extend from two sides of the insulating body 10.

In the second embodiment of the present invention, the divider block 103 is located between the first insulator 101 and the second insulator 102, and each of the main portions 111 of the ground terminals 11 and each of the main portions 121 of the signal terminals 12 are fixed on the first insulator 101 and the second insulator 102 respectively, such that each of the docking portions 110 and 120 of the ground terminals 11 and the signal terminals 12 extends from the first insulator 101 and the second insulator 102 arranged in two opposite rows. Meanwhile, each of the ground terminals 11 fixed on the first insulator 101 and each of the ground terminals 11 fixed on the second insulator 102 may be projected on a virtual plane on the divider block 103 respectively, and each of the docking portions 110 of the ground terminals 11 fixed on the first insulator 101 and each of the docking portions 120 of the ground terminals 11 fixed on the second insulator 102 coincide or nearly coincide on the virtual projection plane.

Figure 13:
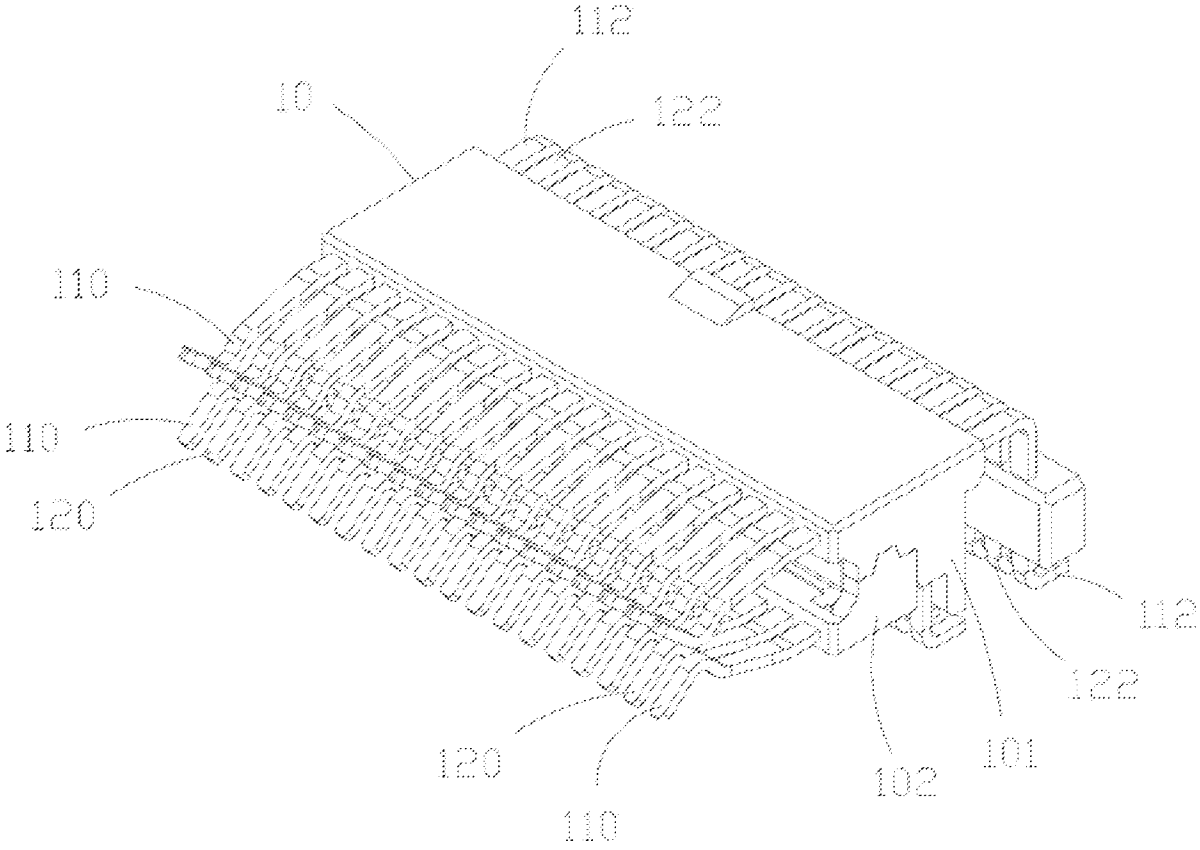
FIG. 13 is a schematic diagram showing a partial structure of the electrical connector structure according to the second embodiment of the present invention.

As shown in FIG. 13, the tail portions 112 and 122 of the ground terminals 11 and the signal terminals 12 extend from the first insulator 101 and the second insulator 102. The tail portions 112 and 122 of the ground terminals 11 and the signal terminals 12 may be electrically connected to a proper circuit on a circuit board. In the second embodiment of the present invention, the first insulator 101 has first openings 104. The second insulator 102 has second openings 105. The first openings 104 and the second openings 105 are corresponding to the main portions 111 of the ground terminals 11, such that the main portions 111 of the ground terminals 11 are partially exposed from the insulators 101 and 102 through the openings 104 and 105.

Figure 14:
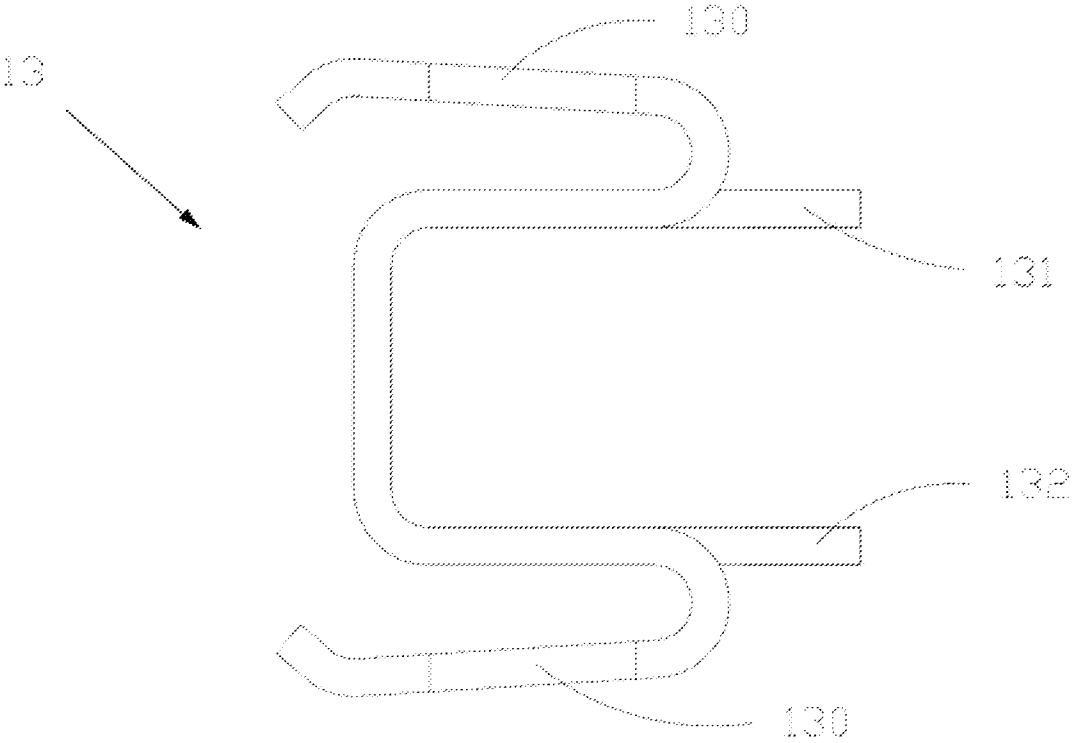
FIG. 14 is a schematic diagram showing a partial structure of the electrical connector structure according to the second embodiment of the present invention.
Figure 15:
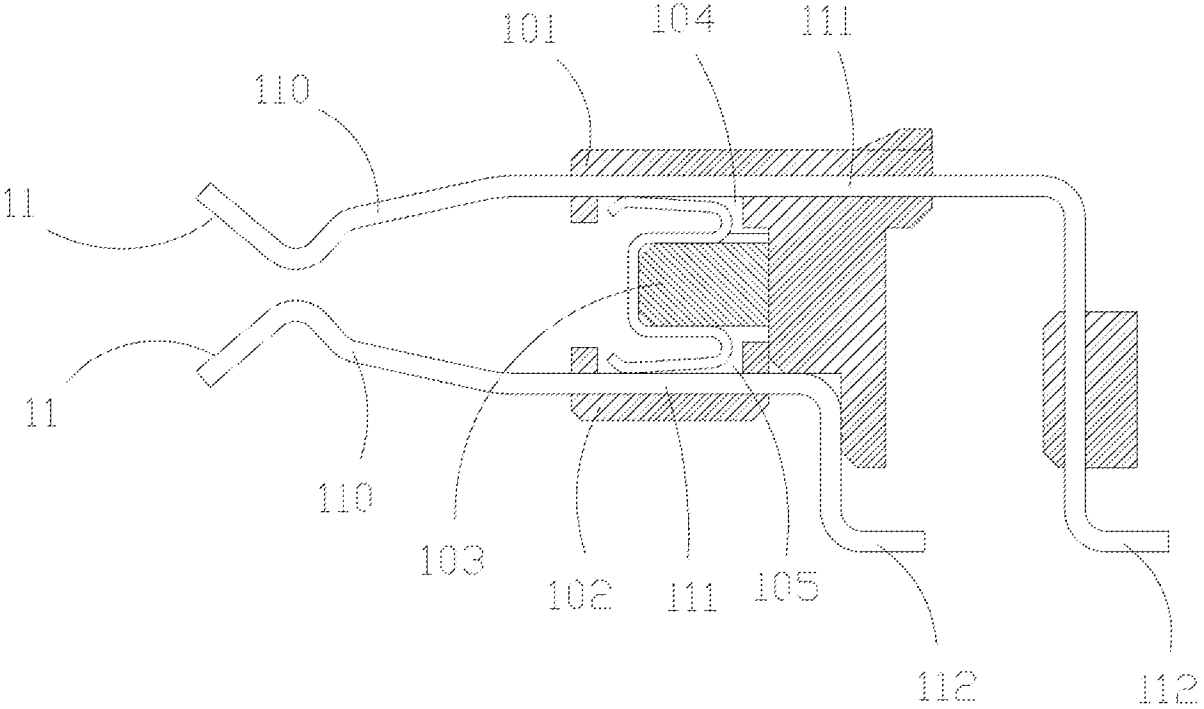
FIG. 15 is a schematic cross-sectional view of the electrical connector structure according to the second embodiment of the present invention.

In the second embodiment of the present disclosure, the grounding piece 13 is formed from a metal thin plate, and is folded to have a first mounting plane 131 and a second mounting plane 132 corresponding to each other. The grounding piece 13 is fixed on the divider block 103. Therefore, the first mounting plane 131 and the second mounting plane 132 are positioned at two opposite surfaces of the divider block 103. As shown in FIG. 14 and FIG. 15, the grounding piece 13 has contact portions 130 installed on the first mounting plane 131 and the second mounting plane 132. The contact portions 130 are arranged in a different manner from that shown in first embodiment of the present invention, but similar to the first embodiment, each of the contact portions 130 is also an elastomer with elastic recovery capability.

In the aforementioned first embodiment shown in FIG. 10, the contact portions 130 extend from the first mounting plane 131 and the second mounting plane 132. Each of the contact portions 130 is an elastomer with elastic recovery capability. The contact portions 130 electrically contact the main portions 111 of the ground terminals 11 directly. In the disclosure of the second embodiment, as shown in FIG. 14, the contact portions 130 extend from the first mounting plane 131 and the second mounting plane 132. The contact portions 130 are then folded reversely toward the docking portions 111 of the ground terminals 11, and electrically contact the main portions 111 of the ground terminals 11 through the first openings 104 and the second openings 105.

In the aforementioned first and second embodiments, the grounding piece 13 is fixed on the divider block 103, but it does not mean that the grounding piece 13 and the divider block 103 must have interference relation, or there must be a friction between the grounding piece 13 and the divider block 103. Using a direct interference relation between the grounding piece 13 and the divider block 103 is merely one of possible enablements of the present invention. Those skilled in the art may fix the grounding piece 13 on the insulating body 10 to keep the grounding piece 13 and divider block 103 in the embodiments at the fixed relative positions. This method of fixing the relative positions of the grounding piece 13 and the divider block 103 by using the insulating body 10 also belongs to the scope of fixing the grounding piece 13 on the divider block 103 disclosed by the present invention.

In the aforementioned first and second embodiments, the insulating body 10 is installed on insulating frame 14, and the relative positions of the insulating body 10, the ground terminals 11, and the signal terminals 12 are fixed by using the insulating frame 14. The aforementioned disclosure is a friendly consideration for an assembling process of production line, but it does not intend to limit the art of the present invention for achieving the function of suppressing high frequency electromagnetic noises. Those skilled in the art may make other changes or modification according to the present invention, such as directly forming the divider block 103 in the insulating frame 14.

In the aforementioned first and second embodiments, the grounding piece 13 is formed from a metal thin plate, in which the effect of high frequency electromagnetic noises on each ground terminal 12 is suppressed by the electromagnetic-shielding characteristic of metal material, and plural contact portions 130 of the grounding piece 13 are used to ground each of the ground terminals 11. Since the material the electromagnetic-shielding characteristic is not limited to a metal thin plate, a non-metal material of which the surface is metalized also has the capability of suppressing high frequency electromagnetic noises. The aforementioned surface metalizing method of the non-metal material includes industrial processes such as a surface treatment, a chemical deposition process, or an electroplating process. Those skilled in the art can realize according to the present invention, the grounding piece 13 of the present invention may be a metal thin plate or a surface-metalized non-metal material. Furthermore, the materials such as conductive plastics or conductive elastomers also belong to the metalized non-metal materials. These metalized non-metal materials also have the electromagnetic-shielding characteristics. In view of the above, in an actual operation of the present invention, the surface-metalized non-metal material has the same or similar applications or efficacy as or to the aforementioned embodiments of the present invention.

By using the aforementioned designs, since the metal shell 15 can be used to isolate the inner electromagnetic interference and the outer electromagnetic interference, the grounding piece 13 is able to have the function of suppressing high frequency electromagnetic noises when high frequency signals are transmitted, thus achieving good shielding effect. By using a brief structure design of the contact portions 130 of the grounding piece 13, the time for fabricating the electrical connector structure is reduced and production yield is increased, thus promoting assembling efficiency and improving the disadvantages of the conventional processes which are complicated and expensive.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An electrical connector structure, comprising:

an insulating body having a divider block;

a plurality of ground terminals fixed on the insulating body and arranged on two opposite sides of the divider block, wherein each of the ground terminals has a docking portion, a main portion, and a tail portion, and the docking portions electrically contact a docking connector, and the main portions are connected to the docking portions and the tail portions, and each of the main portions is fixed on the insulating body, and each of the tail portions extends from the insulating body; and a grounding piece formed from a material having a conductive surface, the grounding piece having a first mounting plane and a second mounting plane corresponding to the first mounting plane, wherein the first mounting plane and the second mounting plane are positioned at two surfaces of the divider block, and the first mounting plane and the second mounting plane have a plurality of contact portions protruding from the first mounting plane and the second mounting plane correspondingly, and the contact portions electrically contact the ground terminals respectively.

2. The electrical connector structure of claim 1, wherein the docking portions of the ground terminals extend from the insulating body and are arranged in two opposite rows.

3. The electrical connector structure of claim 1, wherein the insulating body has a first insulator and a second insulator, and the divider block is located between the first insulator and the second insulator, and the main portions of the ground terminals are fixed on the first insulator and the second insulator respectively.

4. The electrical connector structure of claim 2, wherein the ground terminals are arranged in the same locations of a projection plane.

5. The electrical connector structure of claim 3, wherein the contact portions of the first mounting plane electrically contact the main portions of the ground terminals of the first insulator respectively, and the contact portions of the second mounting plane electrically contact the main portions of the ground terminals of the second insulator respectively.

6. The electrical connector structure of claim 3, wherein the first insulator has a plurality of first openings corresponding to the main portions of the ground terminals, and the contact portions of the first mounting plane electrically contact the main portions of the ground terminals through the first openings.

7. The electrical connector structure of claim 3, wherein the second insulator has a plurality of second openings corresponding to the main portions of the ground terminals, and the contact portions of the second mounting plane electrically contact the main portions of the ground terminals through the second openings.

8. The electrical connector structure of claim 1, wherein the grounding piece is a metalized non-metal material.

9. The electrical connector structure of claim 1, wherein the grounding piece is formed by folding a metal thin plate.

10. The electrical connector structure of claim 1, wherein the grounding piece is U-shaped, and the first mounting plane and the second mounting plane are located at two opposite side arms of the U-shaped grounding piece.

11. The electrical connector structure of claim 1, wherein the contact portions of the grounding piece are elastomers with elastic recovery capabilities.

12. The electrical connector structure of claim 1, wherein the contact portions of the grounding piece are protrusions with no elastic recovery capabilities.

* * * * *